US006494749B1

(12) United States Patent
Chang

(10) Patent No.: US 6,494,749 B1
(45) Date of Patent: Dec. 17, 2002

(54) CONNECTOR WITH MOUNTING FIXTURE FOR REMOVABLE STORAGE DEVICE

(75) Inventor: Che-Chia Chang, Taipei (TW)

(73) Assignee: Comax Technology Inc., Taipei (TW)

( * ) Notice: Subject to any disclaimer, the term of this patent is extended or adjusted under 35 U.S.C. 154(b) by 0 days.

(21) Appl. No.: 09/899,335

(22) Filed: Jul. 5, 2001

(51) Int. Cl.[7] ..... H01R 13/502
(52) U.S. Cl. ..... 439/701; 564/731
(58) Field of Search ..... 439/540.1, 701, 439/731, 564, 906

(56) References Cited

U.S. PATENT DOCUMENTS 4,343,528 A * 8/1982 Lucius et al.
5,513,995 A * 5/1996 Kurotori et al. ..... 439/64
5,975,953 A * 11/1999 Peterson ..... 439/607
6,210,216 B1 * 4/2001 Tso-Chin et al. ..... 439/545

* cited by examiner

*Primary Examiner*—Khiem Nguyen
(74) *Attorney, Agent, or Firm*—Troxell Law Office PLLC

(57) ABSTRACT

The electrical connector with mounting fixture of the present invention comprises a mounting fixture and a two-piece cable mounting cover. The mounting fixture is mounted to the host computer's internal frame (not shown). This internal frame is a standard frame that is included with the computer for mounting fixed hard disk drives, cd-rom drives, and floppy disk drives. The two-piece cable mounting cover encases the data cable connector and the power cable connector and is mounted to the mounting fixture. The other end of the data cable is connected to the host computer's motherboard. Utilizing the electrical connector with mounting fixture of the present invention, a removable mass storage device can be conveniently removed from or installed into a host computer. Additionally, the present invention significantly reduces the number of connectors, adapters, and connections. Therefore, the problems associated with the conventional removable hard disk drive assembly can be avoided and a more convenient, simple, durable, and inexpensive assembly is provided.

3 Claims, 3 Drawing Sheets

CONNECTOR WITH MOUNTING FIXTURE FOR REMOVABLE STORAGE DEVICE

BACKGROUND OF THE INVENTION

1. Field of Invention

The present invention relates generally to an electrical connector. More particularly, the present invention relates to a connector with mounting fixture for connecting a removable storage device to a host computer.

2. Description of the Related Art

Hard disk drives are typically installed inside of a computer system and used for storing data. However, for security and convenience purposes, removable hard drives are also available. This type of hard drive can be removed from the computer system by a user and taken to another location or computer for use or secure storage.

The conventional assembly includes a hard disk drive, an adapter case, and a mounting case. The hard disk drive has a fixed data connector and a fixed power connector. The adapter case includes a mounted connector, printed circuit board (PCB), a data cable with two connectors, and a power cable with connector. The mounted connector is fixed on the printed circuit board along with one of the data cable connectors. The mounting case includes a connector mounted to a small PCB that also has a data connector and power connector mounted on it. Finally, in order to connect the conventional removable hard disk drive assembly to the host computer, a ribbon cable with two connectors must be attached. One end of the ribbon cable attaches to the mounting case data connector and the other end attaches to a connector fixed on the motherboard of the computer.

As can be seen, the conventional removable hard disk drive assembly, in addition to the adapter case and mounting case, requires numerous connectors, cables, printed circuit boards, and adapters.

This multitude of connections is not only cumbersome to install but is also very susceptible to having any number of problems such as data loss, errors, and damage.

Therefore, there is need for an improved removable hard disk drive assembly that overcomes the disadvantages of the conventional removable hard disk drive assembly.

SUMMARY OF THE INVENTION

In order to overcome the disadvantages of the conventional assembly, the present invention provides an electrical connector with mounting fixture for connecting a removable storage device to a host computer without requiring a multitude of connectors, cables, printed circuit boards, and adapters.

The electrical connector with mounting fixture of the present invention comprises a mounting plate or fixture and a two-piece cable mounting cover. The mounting fixture is mounted to the host computer's internal frame. This internal frame is a standard frame that is included with the computer for mounting fixed hard disk drives, cd-rom drives, and floppy disk drives. The two-piece cable mounting cover encases the data cable connector and the power cable connector and is mounted to the mounting fixture. The other end of the data cable is connected to the host computer's motherboard. Since the cable connectors are firmly held in the proper arrangement and alignment, the previously fixed storage device can be conveniently converted into a removable storage device. The present invention also allows other system improvements to be implemented without requiring the use of special connectors, pcb's, or cables.

Utilizing the electrical connector with mounting fixture of the present invention, a mass storage device can be conveniently removed from or installed into a host computer.

It can be clearly seen that the present invention significantly reduces the number of connectors, adapters, and connections. Therefore, the problems associated with the conventional removable hard disk drive assembly can be avoided and a more convenient, simple, durable, and inexpensive assembly is provided.

Both the foregoing general description and the following detailed description are exemplary and explanatory only and are not restrictive of the invention, as claimed.

BRIEF DESCRIPTION OF THE DRAWINGS

The accompanying drawings are included to provide a further understanding of the present invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

In order to overcome the disadvantages of the conventional removable storage device connection assembly, the present invention provides an electrical connector with mounting fixture that utilizes standard connecting cables mounted to a fixture that enables a mass storage device to be conveniently removable from a computer system.

Figure 1:
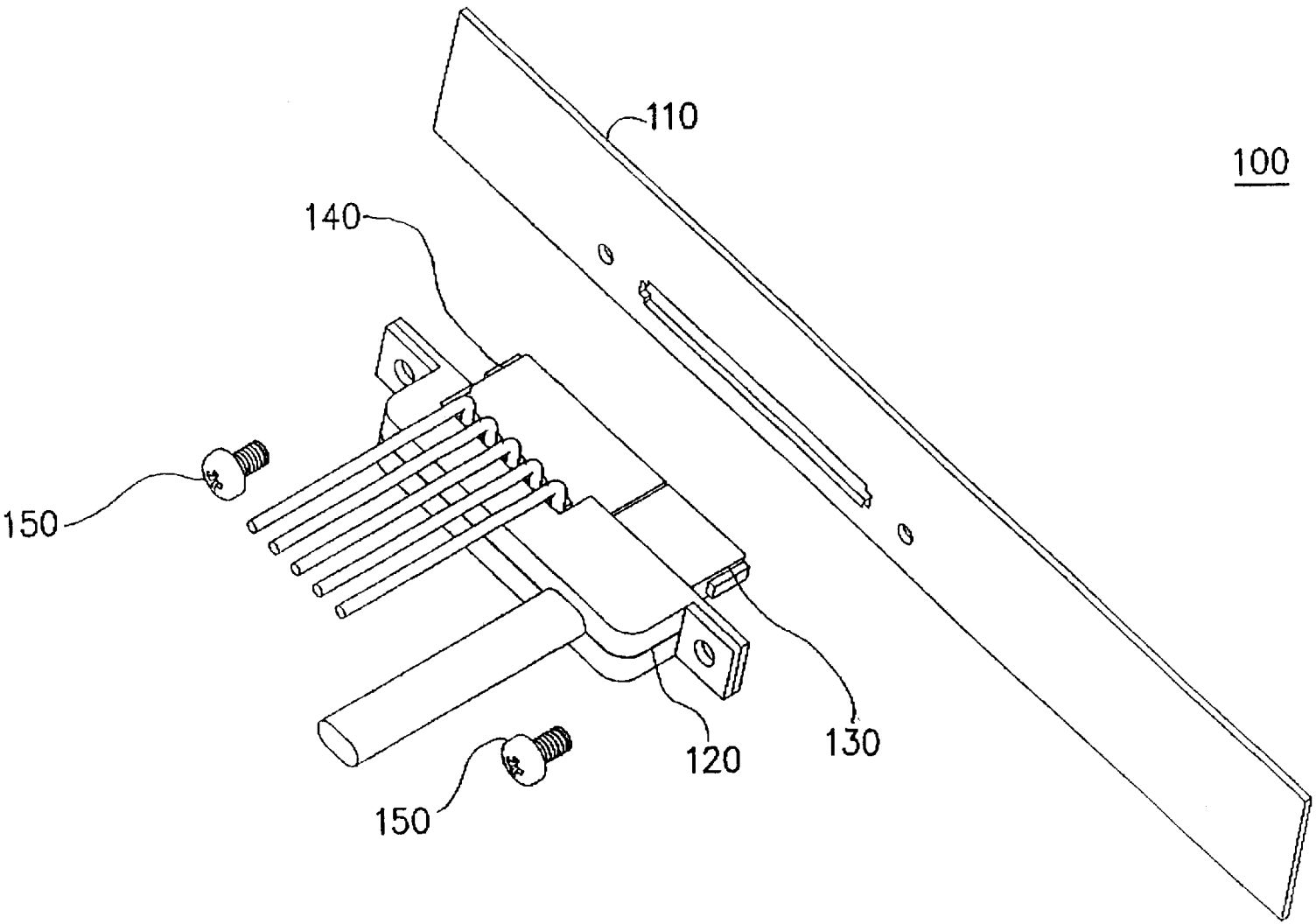
FIG. 1 is an assembly drawing showing an electrical connector with mounting fixture according to an embodiment of the present invention.
Figure 2:
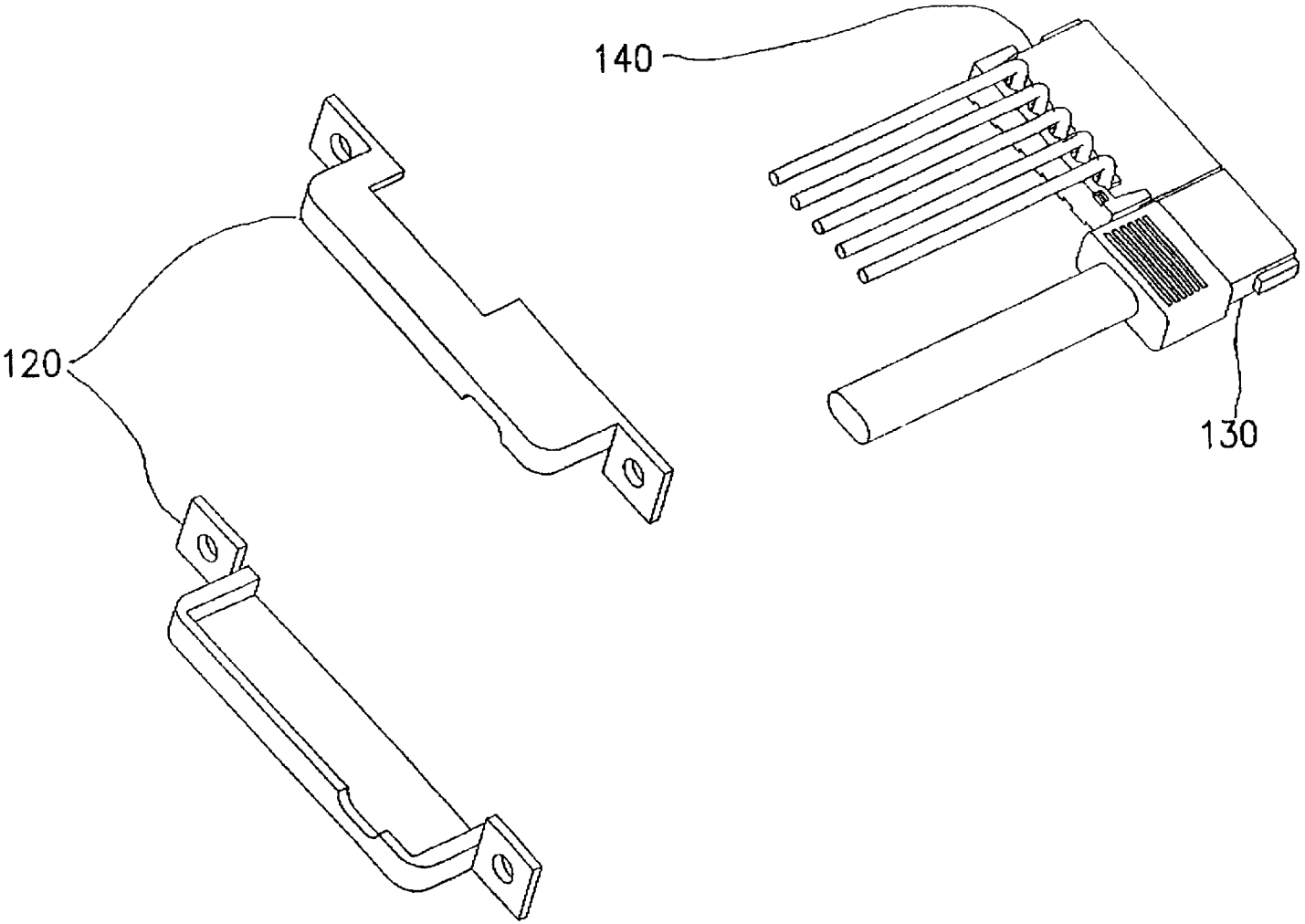
FIG. 2 is a component drawing showing cables, connectors and cover of an electrical connector with mounting fixture according to an embodiment of the present invention.
Figure 3:
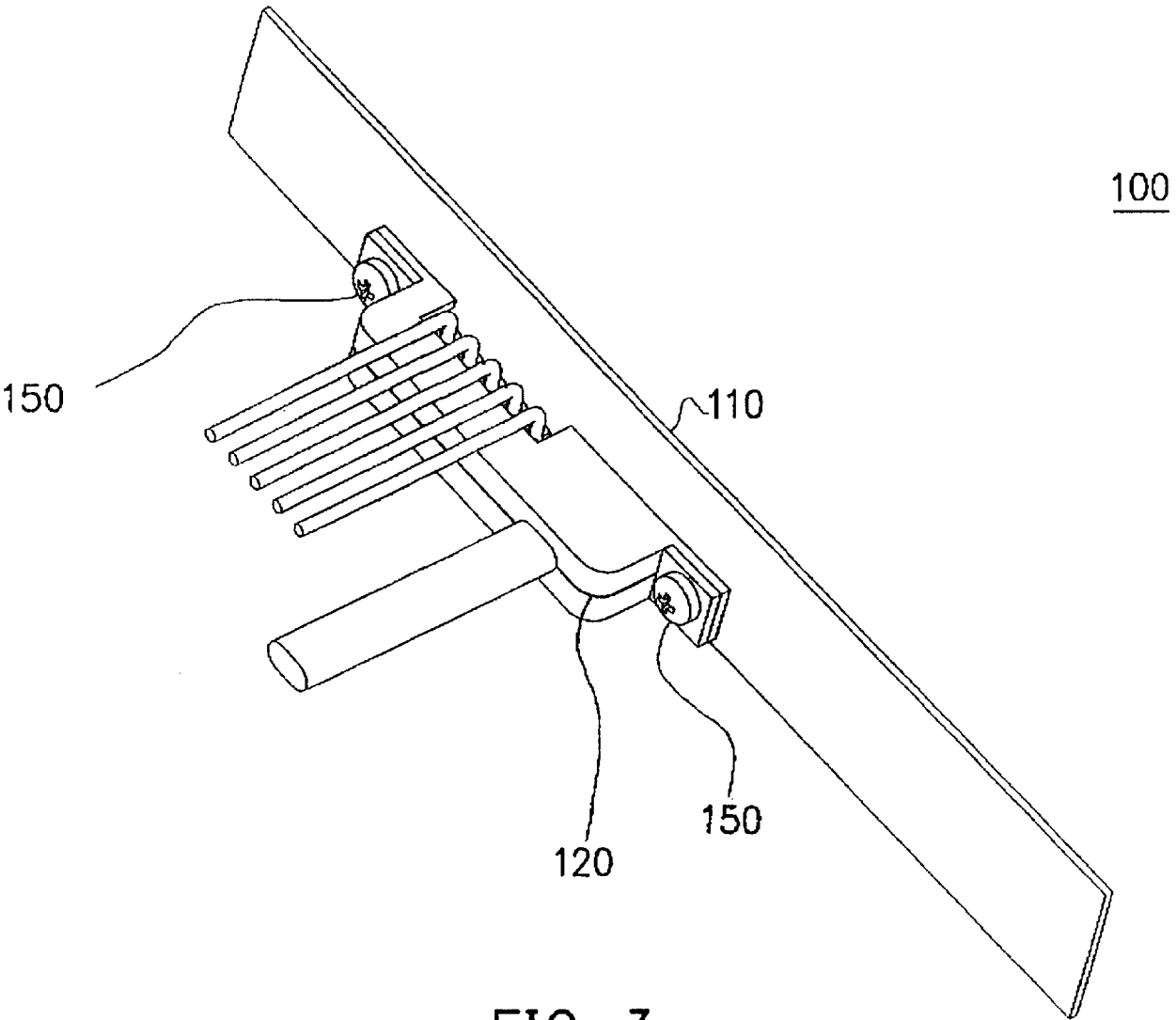
FIG. 3 is a drawing showing an assembled electrical connector with mounting fixture according to an embodiment of the present invention.

Refer to FIG. 1, which is an assembly drawing showing an electrical connector with mounting fixture according to an embodiment of the present invention, FIG. 2, which is a component drawing showing cables, connectors and cover of an electrical connector with mounting fixture according to an embodiment of the present invention, and FIG. 3, which is a drawing showing an assembled electrical connector with mounting fixture according to an embodiment of the present invention.

The electrical connector with mounting fixture 110 of the present invention comprises a mounting fixture 110 and a two-piece cable mounting cover 120. The mounting fixture 110 is mounted to the host computer's internal frame (not shown). This internal frame is a standard frame that is included with the computer for mounting fixed hard disk drives, cd-rom drives, and floppy disk drives. The two-piece cable mounting cover 120 encases the data cable connector 130 and the power cable connector 140 and is mounted to the mounting fixture 110. The other end of the data cable is connected to the host computer's motherboard (not shown). The cable connector mounting cover 120 can be attached to the mounting fixture 110 with screws 150, rivets, welding, or other fastening means.

In many cases, the data cable and power cable are standard cables that are utilized in a fixed mass storage device system. The data cable connector 130 and power cable connector 140 are encased by the two-piece mounting cover 120 and mounted to the mounting fixture 110 in an appropriate position to match the associated connectors fixed to the storage device. This allows a standard storage device to be easily converted into a removable storage device, providing a more versatile computer system. By utilizing standard cables and connectors, the need for extra cables, pcb's, and connectors needed by the conventional assembly are not required.

For example, in a serial advanced technology adapter (SATA) system, the data cable connector 130 has 7 pins and the power cable connector 140 has 15 pins. The power cable connector 140 is aligned next to the data cable connector 130. Then, the two-piece connector cover 120 is positioned to encase the two connectors, thus aligning the power cable connector 140 and data cable connector 130. This subassembly is then mounted onto the mounting fixture 110, which has been attached to the computer's internal frame. The positioning of the data cable connector 130 and the power cable connector 140 is such that the two connectors match the correct positioning of the appropriate mating connectors fixed to the storage device that is to be installed.

Note that this example is given for a serial ATA connector system. However, other interfaces or connector systems can also be utilized. The present invention is also not limited to work with just hard disk drives but also works with other devices such as cd-rom drives, dvd drives, floppy disk drives, and any other types of devices that can connect to a host computer system. Additionally, the figures illustrate a flat mounting plate. However, the mounting fixture of the present invention is not limited to a flat plate only. Other fixtures with, for example, mounting tabs or ears or other means of attachment or shape are included in the present invention. Obviously, the shape and positioning of the mounting hole or holes in the mounting fixture is adaptable depending on connector type and location.

Utilizing the electrical connector with mounting fixture of the present invention, a mass storage device can be conveniently removed from or installed into a host computer. Furthermore, the present invention allows a storage device that is fixed in a computer to be converted to a removable type storage device. In addition, the present invention adds increased benefits such as enabling hot swappable storage devices to be removed or added in a hot swap manner.

It can be clearly seen that the present invention significantly reduces the number of connectors, adapters, and connections. Therefore, the problems associated with the conventional removable hard disk drive assembly can be avoided and a more convenient, simple, durable, and inexpensive assembly is provided.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A connector assembly with a mounting structure for removably connecting a removable storage device to a host computer having an internal frame and comprising:

a) a mounting fixture mounted on the internal frame of the host computer, the mounting fixture having an elongated slot therethrough;

b) a plurality of cables including at least a power cable and a data cable, each having a connector with at least one wire extending therefrom;

c) a mounting cover engaged with all of the connectors of the plurality of cables so as to hold the connectors adjacent to one another such that the at least one wire from each connector and a portion of each connector extends exteriorly of the mounting cover, the mounting cover including first and second portions, each portion having flanges extending outwardly from opposite sides thereof such that the flanges from the first portion overlap corresponding flanges from the second portion; and, d) fasteners extending through the overlapped flanges and engaging the mounting fixture so as to removably connect the mounting cover and connectors to the mounting fixture such that portions of the connectors extend through the elongated slot in the mounting fixture.

2. The connector assembly of claim 1 wherein the fasteners comprise threaded fasteners.

3. The connector assembly of claim 1 wherein the data cable comprises a serial advanced technology adapter cable.

* * * * *